US005952141A

United States Patent [19]

Ohno et al.

[11] Patent Number: 5,952,141

[45] Date of Patent: Sep. 14, 1999

[54] PHOTORECEPTOR DRUM WITH SPECIFIED FLANGE

[75] Inventors: Masashi Ohno; Tatsuo Nakanishi, both of Hachioji, Japan

[73] Assignee: Konica Corporation, Japan

[21] Appl. No.: 08/967,490

[22] Filed: Nov. 11, 1997

[30] Foreign Application Priority Data

Nov. 15, 1996 [JP] Japan ..... 8-304572

[51] Int. Cl.[6] ..... G03G 5/10

[52] U.S. Cl. ..... 430/69; 399/159; 399/116; 399/117; 430/56

[58] Field of Search ..... 430/56, 69; 399/116, 399/117, 159

[56] References Cited

U.S. PATENT DOCUMENTS 5,023,660 6/1991 Ebata et al. .
5,128,715 7/1992 Furuyama et al. .
5,455,135 10/1995 Maruyama et al. ..... 399/159
5,521,678 5/1996 Riehle et al. .
5,599,265 2/1997 Foltz ..... 399/159

FOREIGN PATENT DOCUMENTS 0506576 9/1992 European Pat. Off. .
0731390 9/1996 European Pat. Off. .

OTHER PUBLICATIONS

Search Report—European EP 97 11 9748 (1998).
1 pg. XP–002057229 Abstract, Derwent Abstract (1993).

*Primary Examiner*—Christopher D. Rodee
*Attorney, Agent, or Firm*—Jordan B. Bierman; Bierman, Muserlian and Lucas

[57] ABSTRACT

A photoreceptor drum having flanges at the ends of a cylindrical substrate is disclosed. The flange contains a heat-resistant thermoplastic resin and a compound comprising a metal selected from a group consisting of Sb, Sn, Pb, Ge, Ga and Zn.

18 Claims, 2 Drawing Sheets

PHOTORECEPTOR DRUM WITH SPECIFIED FLANGE

FIELD OF THE INVENTION

The present invention relates to a photoreceptor drum used for an electrophotographic copying machine, an electrophotographic-printer and facsimile.

Heretofore, a photoconductive layer is provided on a cylindrical electric conductive substrate of a photoreceptor drum for forming a photoreceptor. As well, to an aperture on both ends of the electric conductive substrate, a metallic flange such as aluminum or an insulating flange such as plastic are engaged.

The above-mentioned photoreceptor drum has been rotatably supported on a rotation shaft which extends from the main body of a copying machine through the above-mentioned shaft hole of the flange so that images are formed during rotation of the photoreceptor drum by means of a driving source. During the image formation, grounding of the above-mentioned photoreceptor drum is necessary.

When an insulating flange is employed, it is known that an elastic grounding plate which is brought into pressure contact with an electric conductive substrate of the above-mentioned photoreceptor drum and a rotation shaft which extends from the main body of the above-mentioned copying machine is provided inside the flange to be grounded.

However, according to a grounding method employing the above-mentioned elastic grounding plate, a structure can become complicated. In addition, an grounding plate may be abraded and deformed to lose electrical conductivity. As a result, there is a shortcoming that it lacks in reliability. In addition, according to a method of grounding by the use of a metallic flange, a special bearing is provided on an shaft hole as described above. In this method, processing cost is expensive and the weight of the flange becomes excessively large.

Japanese Utility Publication Open to Public Inspection Nos. 59-153568 and 61-182565 and Japanese Patent Publication Open to Public Inspection (hereinafter, referred to as Japanese Patent O.P.I. Publication) No. 61-100764 disclose a flange for a photoreceptor drum employing an electric conductive resin in which a agent giving conductivity such as carbon black, graphite, carbon filler and metallic powder, polyethylene, polypropylene, polyvinyl chloride, polyethylene, an ABS resin nylon, polycarbonate, polybutyleneterephthalate and polyethylene fluoride are caused to be dispersed and incorporated in a resin. In addition, Japanese Patent O.P.I. Publication discloses a technology to use a material in which a furnace carbon and carbon filler are dispersed and incorporated in an fire-retardant thermoplastic resin for a flange member.

SUMMARY OF THE INVENTION

In the case of technologies described in each of the above-mentioned specifications, it is impossible to provide slide-contacting property, grounding property and fire-retarding property which are currently demanded. Specifically, it has been difficult to provide durability which can maintain sure slide-contacting property and grounding property after using for a long period.

Objects of the present invention are, practically, to provide a flange employing an electric conductive resin capable of providing sure slide-contacting property and grounding performance after using for a long period extremely and also provide sufficient fire-retarding property. Due to this, grounding of a photoreceptor drum can sufficiently be conducted. In addition, a photoreceptor drum in which a flange excellent in mechanical strength wherein abrasion with a rotation shaft and damage do not occur and, accordingly, noise during operation time and defective image do not occur is integral.

The photoreceptor drum and its embodiment are described.

The photoreceptor drum comprises flanges provided at ends of a cylindrical electric conductive substrate having a photoconductive layer. The flange contains a heat-resistant thermo-plastic resin and a compound comprising a metal selected from a group consisting of Sb, Sn, Pb, Ge, Ga and Zn.

The flange preferably comprises a flange shaft bearing member.

The flange preferably contains a carbon filler.

The flange contains a polyester elastomer as a raw material.

The preferable example of the metal of the compound comprising a metal is Sb.

The preferable example of the compound comprising a metal is oxide compound containing antimony, and preferable example is antimony pentaoxide.

The preferable example of the heat-resistant thermoplastic resin is a polycarbonate, a polyethylene terephthalate, a polybutylene terephthalate or an ABS, and more preferably a polybutylene terephthalate.

The carbon filler has preferably 10 $m^2/g$ or more in terms of BET specific surface area.

The flange preferably contains a fire retardant.

The preferable embodiment of the flange contains a heat-resistant thermo-plastic resin at 55 to 80 parts by weight and the compound comprising a metal selected from a group consisting of Sb, Sn, Pb, Ge, Ga and Zn at 2 to 15 parts by weight, the polyesterelastomer at 2 to 8 parts by weight, the carbon filler at 4 to 20 parts by weight and the fire retardant at 3 to 20 parts by weight.

The preferable example of the fire retardant is a bromine-containing fire-retardant.

The preferable example of the bromine-containing fire retardant is a teterabromocyclododecane, a bistribromophenoxyethane, a tribromophenol, an ethylenebistetra bromophthalimide, a polydibromophenylene oxide, a pentabromobenzeylpolyacrylate or a tetrabromophathalic acid.

The preferable embodiment of drum comprises flanges provided at ends of a cylindrical electric conductive substrate having a photoconductive layer, wherein the flange contains a heat-resistant thermo-plastic resin and a polyester elastomer, carbon black, antimony pentaoxide and a bromine-containing fire-retardant in the resin.

The image forming apparatus comprises a photoreceptor drum in which flanges are provided at ends of a cylindrical electric conductive substrate having a photoconductive layer, wherein the flange is formed by containing a heat-resistant thermo-plastic resin and a polyester elastomer, carbon black, antimony pentaoxide and a bromine-containing fire-retardant in the resin.

Figure 1:
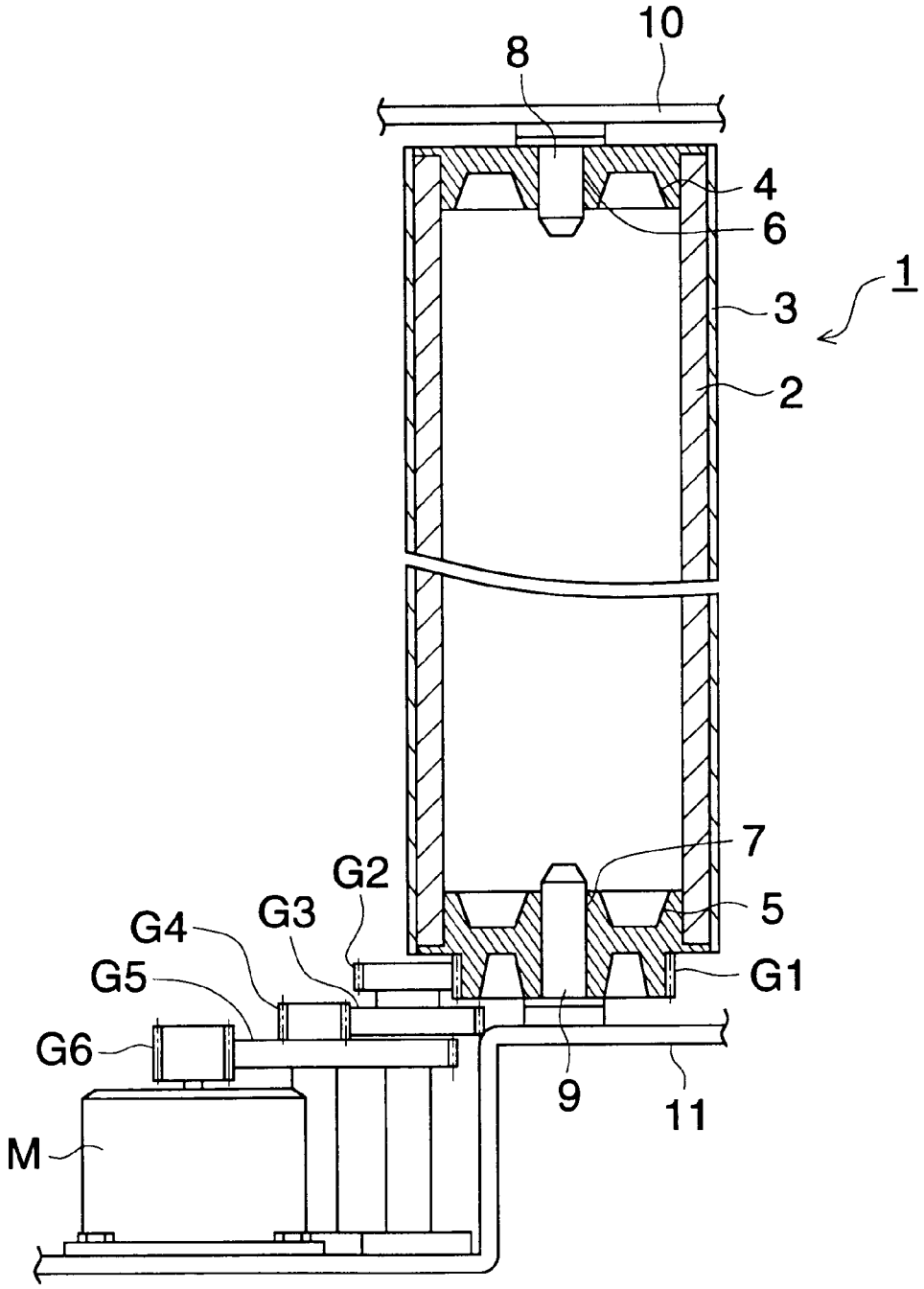
FIG. 1 is a cross sectional view showing a photoreceptor drum of the present invention and a driving mechanism thereof.

1. Photoreceptor drum
2. electric conductive substrate
3. Photoconductive layer
4 and 5. Flange
6 and 7. Shaft hole
8 and 9. Rotation shaft
10 and 11. Side plate
12. Grounding plate
13. Screw
14. Flange shaft bearing member
G1 through G6. Gear

DETAILED DESCRIPTION OF THE INVENTION

The photoreceptor drum of the present invention is a photoreceptor drum in which a flange is mounted at the ends of a cylindrical electric conductive substrate having a photoconductive layer. The flange contains a heat-resistant thermo-plastic resin and a compound comprising a metal selected from a group consisting of Sb, Sn, Pb, Ge, Ga and Zn. On a cylindrical electric conductive substrate, for example aluminum, an inorganic or organic photoconductive layer is provided. At the cylindrical aperture at both sides of the above-mentioned electric conductive substrate, the flange containing a heat-resistant thermoplastic resin and a compound comprising a metal selected from a group consisting of Sb, Sn, Pb, Ge, Ga and Zn, a flange containing a polyester elastomer, carbon black, antimony pentaoxide and a bromine-containing fire-retardant in a heat resistant thermo-plastic resin is mounted. When a flange bearing member is an independently existing member, it contains both of a flange as a part of a flange and a flange bearing member integrally molded and processed.

The photoreceptor drum is rotatably supported by a fixed rotation shaft extended from main body of a copying machine through an shaft hole of a flange on the above-mentioned both ends. The photoreceptor drum is rotatably driven by a driving source through a gears for transmitting provided on one of a flanges and plural reducing gears combined for engaging with the gears for transmission. In this occasion, grounding of a photoreceptor drum is conducted via main body of the copying machine through a rotating shaft penetrating an shaft hole of the flange.

During operation, a photoreceptor drum occurs abrasion of both of a rotation shaft and damage and thereby causes noise due to slide-contacting between an shaft hole of a flange and a rotation shaft penetrated to the shaft hole (it is referred to as "squealing of flanges"). Therefore, in the gap between a rotation shaft and an shaft hole of a flange, conductive grease is used for the sure slide-contacting. After use for a long period, toner splashed invades, clogging the conductive grease, resulting in poor slide-contacting and grounding problem and causing defective image such as step unevenness and fogging.

The present invention provides sufficient mechanical strength and slide-contacting property. Thereby, use of the conductive grease used for minimizing the occurrence of noise can be abolished. Heretofore, it was found that flange squealing which used to occurs at about 1,000 copies without the use of the conductive grease does not occur until at least of after copying 200,000 copies.

The wiring of a flange employing a conventional electric conductive resin can short out in any of various mechanical problems located around a photoreceptor drum, and a flange may be scorched due to excess current which passes the photoreceptor drum so that the flange is inflamed to cause problems.

However, the flange of the present invention satisfies mechanical strength and dimension stability during injection molding. Simultaneously with this, standard of UL94 for fire-resistance grade VO can also be satisfied.

Standard of UL94 for fire-resistance grade VO shows to have a self-extinguishing property.

During operation, a photoreceptor drum is grounded to a copying machine main body through an shaft hole of a flange and a rotation shaft penetrated to the shaft hole. In order to sufficient conductivity of the flange, selection of a conductive agent and its content are important issues. Further, the content of agent giving conductivity is related to mechanical strength and anti-abrasion property, and therefore, the selection of the kind of an agent giving conductivity and its amount which do not damage the mechanical strength of the flange becomes an important issues.

According to the invention the flange excellent in mechanical strength and fire-resisting property in which grounding of a photoreceptor drum can sufficiently be conducted, abrasion with a rotation shaft and damage thereby do not occur and, therefore, no noise during operation and defective image occur was developed, and a photoreceptor drum in which the flange is integral could be provided.

When a metallic flange is used, the photoreceptor drum is grounded due to contact between the above-mentioned rotation shaft and a flange shaft hole or bearing such as brass provided in the shaft hole. Therefore, the above-mentioned grounding plate must be unnecessary. However, actually, at a portion at which a rotation shaft and a flange shaft hole or a bearing provided in the shaft hole, in order to improve slide-contacting property, a bearing is used. To there, a lubricant oil such as grease is also used. In order for these to improve their grounding property, conductive ones may be used. Though conductive ones are used, splashed toner is mixed during use for a long period. As a result, coagulation or defective conductivity occur so that properties as of the present invention cannot be obtained.

As the heat-resistant thermo-plastic resin for the flange, resins excellent in heat resistance and slide-contacting property such as polycarbonate, polyethylene terephthalate, polypropylene terephthalate, polybutylene terephthalate and ABS resin are preferable. Specifically, the above-mentioned polybutylene terephthalate is favorable. These resins may contain copolymer component. In this instance the component of the heat-resistant thermo-plastic resin is preferably more than 30 mol %, more preferably 50 mol %, and further, 80 mmol %.

In the resin the compound containing a metal of Sb, Sn, Pb, Ge, Ga or Zn. Preferable example of the compound is an oxide of the metal. Preferable example of the metal is Sb. The preferable example of the compound is $TiO_2$, $SnO_2$, $Sb_2O_5$, $Sb_2O_3$ and ZnO. The most preferable example of the compound is antimony pentaoxide. The preferable amount of the compound is 2 to 15 parts by weight, more preferably 5 to 8 parts by weight, of the flange.

The flange preferably formed by containing a polyester elastomer. The preferable amount of the polyester elastomer is 2 to 8 parts by weight and more preferably 4 to 6 parts by weights, of the flange. The polyester elastomer has a polyester as a hard segment in a molecule and a polyether having low glass transition temperature (Tg) as a soft segment or a multi-block copolymer employing a polyester. Typically, there are the following two types.

(1) Polyester•polyether type

Hard segment: Aromatic group type crystalline polyester

Soft segment: Polyether

For example, there are those having the following structures:

Hard Segment

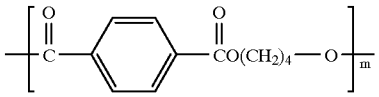

Soft Segment

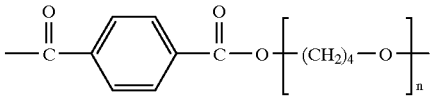

In the formulas m is about 5 to 25, n is about 2 to 4.

(2) Polyester•polyester type

Hard segment: Aromatic group type crystalline polyester

Soft segment: Aliphatic group polyester

For example, there are those having the following structures:

Hard Segment

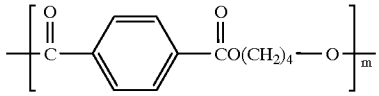

Soft Segment

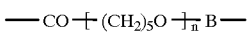

or

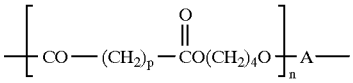

provided that A and B are chain-lengthening agents (low molecular diol, for example, diol having 1 to 6 carbon atoms). In the formulas m is about 5 to 25, n is about 2 to 4.

Commercially available examples of the above-mentioned compounds include Pelprene (produced by Toyo Boseki Co., Ltd.), Hi-trel (Toray and Du Pont), Grilux E (Aquzo Inc.) and D-Mod (General Electric Inc.).

It is preferable that the flange contains carbon filler. It is also preferable that the carbon filler has 10 $m^2/g$ or more interms of BET specific surface area, more preferably 300 $m^2/g$ or more, and particular preferably 700 $m^2/g$ or more and usually up to 1200 700 $m^2/g$. The carbon filler is preferably used in an amount of 4 to 20 parts by weight and more preferably 7 to 10 parts by weight, of the frange. A preferable example of the carbon filler is carbon black. Average particle size of the carbon black is 1 $\mu$m to 1 $\mu$m. As the carbon black for the flange, furnace black is preferably used. This furnace black is manufactured by a special method in which oil is blown in a furnace, and flamed continuously. In the flammation, water is sprayed for cooling and collecting. For this reason, this furnace carbon black is excellent in terms of conductivity compared with conventional carbon black. Its particles are porous having a large specific surface area and is excellent in terms of dispersion property into a resin.

As a commercially available product of a furnace black, for example, Kottigen black EC (BET specific surface area is 800 $m^2/g$) and Kottigen black EC600JD (BET specific surface area is 1270 $m^2/g$) produced by International Inc., Conductex 40-220 (BET specific surface area is 1066 $m^2/g$) produced by Colombian Inc. and Printex XE-2 (BET specific surface area is 1000 $m^2/g$) produced by Degsa Inc. All of them are porous having a large specific surface area of carbon particles. The particle specific surface area of furnace black preferably used is, in terms of BET specific surface area, preferable 700 $m^2/g$ or more and more preferably 800 $m^2/g$ or more.

It is preferable that the flange contains fire-retardant. The fire-retardant is preferably used in an amount of 3 to 20 parts by weight and more preferably 10 to 15 parts by weight, of the flange. The fire-retardant includes bromine-containing fire-retardant such as tetrabromocyclododecane, bistribromophenoxyethane, tribromophenol, ethylenebistetrabromophthalimide, polydibromophenyleneoxide, pentabromobenzylpolyacrylate and tetrabromophthalic acid; phosphor-containing fire-retardant such as phosphoric ester fire-retardant, halogen-contaninging phosphoric ester fire-retardant and polyphosphoric acid fire-retardant; chlorine-containing fire-retardant such as perchlorocyclopentadecane and tetrachlorophthalic acid anhydride; inorganic fire-retardant such as aluminum hydroxide and magnesium oxide. Among the fire-retardant the bromine-containing fire-retardant is preferably used. Two or more thereof may be used in combination.

The flange is a flange capable of withstanding abrasion due to friction between the shaft hole and the rotation shaft of the above-mentioned flange. In order to attain the objects of the above-mentioned present invention more preferably, the above-mentioned flange section or at least a flange shaft bearing member contains a heat-resistant thermoplastic resin such as polybutylene terephthalate at 55–80 parts (hereinafter, unless not specifically cited, "part" represents "part by weight") and preferably 65–70 parts, a polyester elastomer at 2–8 parts and preferably 4–6 parts, furnace carbon black at 4–20 parts and preferably 7–10 parts, antimony pentaoxide at 2–15 parts and preferably 5–8 parts and a bromine-containing fire-retardant at 3–20 and preferably 10–15 parts.

Volume resistance ratio of the flange is preferably less than $10^2$ Ω·m to obtain sufficient grounding function of the flange and good image formation performance.

These raw materials are mixed by kneading and then the kneaded composition is molded by injection to prepare the flange.

FIG. 1 is a cross sectional view showing a photoreceptor drum and a driving mechanism which rotates and drives a photoreceptor drum of the present example. In FIG. 1, photoconductive layer 3 is provided on cylindrical electric conductive substrate 2 in a photoreceptor drum. At the aperture portion of both ends of the above-mentioned electric conductive substrate 2, flanges 4 and 5 employing an electric conductive resin of the present invention are engaged with.

The above-mentioned photoreceptor drum 11 is rotatably supported by engaging flanges 4 and 5 and shaft holes 6 and 7 on rotation shaft 8 and 9 which is fixed to the side plates 10 and 11 on the main body of the copying machine. The above-mentioned photoreceptor drum 1 is rotatably driven by motor M through gear G1 for transmitting and gear for reducing gears G2, G3, G4, G5 and G6.

On the above-mentioned photoreceptor drum, image formation is conducted under rotation by the driving source. For forming the image formation, grounding of a photoreceptor is essential. If an insulating flange is used, a method to ground by providing an elastic grounding plate which is brought into contact with an electric conductive substrate of a photoreceptor drum and a rotation shaft which extends from the main body of a copying machine inside the flanges is known.

On the other hand, if a metallic flange is used, theoretically, the above-mentioned grounding plate becomes unnecessary. the rotation shaft and the flange shaft hole are grounded through a bearing such as brass provided on the shaft hole.

However, according to a grounding method employing the above-mentioned elastic grounding plate, a structure becomes complicated. In addition, an grounding plate may be abraded and deformed to lose electrical conductivity. As a result, there is a shortcoming that it lacks in reliability. In addition, according to a method of grounding by the use of a metallic flange, a special bearing is provided on an shaft hole as described above. By this method, processing cost is expensive and the weight of the flange becomes large. In addition, though theoretically, a grounding plate is unnecessary, the grounding plate must be provided as a countermeasure for defective conductivity caused by coagulation of conductivity grease by splashing toner as described above.

As a countermeasure for the above-mentioned problems, a flange employing an electric conductive resin is known. However, mechanical strength and slide-contacting property tends to be lacking. Specifically, after using for a long period, maintaining durability) of performances becomes problematic. As described over and over again, due to coating of a conductive grease onto a shaft hole section, friction and damage are minimized, which absorbs splashed toner and dust, causing sticking. Defective grounding and insufficient rotation are caused. The present invention solves the above-mentioned problems completely.

Figure 2:
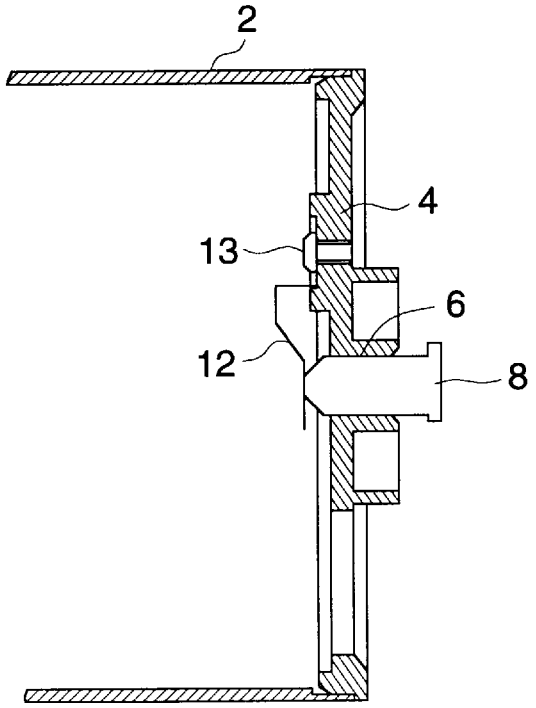
FIGS. 2(*a*) and 2(*b*) are schematic cross sectional views of FIG. 1.
Figure 2:
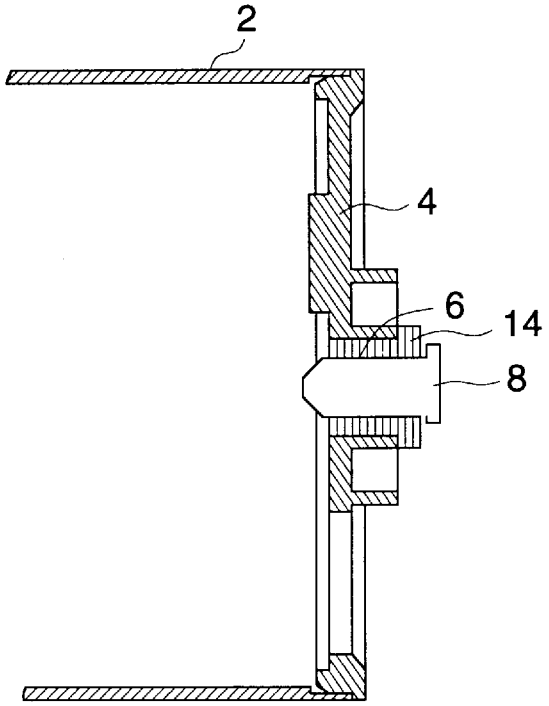

FIG. 2 shows schematic view of FIG. 1. Due to this, an embodiment of the present invention will be explained.

FIG. 2(*a*) shows a conventional type, in which flange 4 is made of an electric conductive material such as an electric conductive resin or aluminum. Numeral 8 represents a rotation shaft, numeral 12 represents an grounding plate which is fixed to the flange with screw 13.

The grounding material is made of a phosphoric bronze. It is abraded due to friction with a rotation shaft, tending to cause defective grounding. In addition, it is necessary to maintain with a screw and to process for folding. Therefore, it becomes expensive in terms of cost.

On the contrary, FIG. 2(*b*) is an embodiment of the present invention. By employing the materials of the present invention for flanges, at least bearing member 14 for the flanges (in this occasion, members different from the flange are illustrated), a lubricant such as a grease is not necessary. Grounding becomes sure. In addition, it is easy to manufacture. Therefore, it is profitable in terms of cost.

EXAMPLES

Hereinafter, the present invention will be explained in detail referring to examples.

A photoreceptor drum is prepared in the following manner. Based on an aluminum-withdrawn tube, the surface roughness of an aluminum drum whose outer diameter was 80 mm and the length was 355 mm was arranged to be 0.3 $\mu$m by the use of a diamond bit. After the aluminum drum was cleaned sufficiently, a subbing layer was formed by means of a dipping method. On the subbing layer, a photoconductive layer in which a charge generation layer and a charge transport layer were successively laminated was formed for obtaining a photoreceptor for the present example.

The structure of a flange engaged with the photoreceptor was changed so that 9 kinds of flange were prepared and engaged with the above-mentioned photoreceptor. Thus, photoreceptor drum examples 1 through 8 and comparative photoreceptor drum 1 for the comparison were obtained.

Each of the above-mentioned photoreceptor was loaded in Konica U-BIX 4155 (produced by Konica Corporation), and subjected to an actual copying test up to 300,000 copies.

In Table 1, each characteristic was displayed under the following requirements.

1. Specific Volume Resistance

For evaluation of conductivity, the specific volume resistance was measured by means of a Rhorester AP MCP400 (manufactured by Mitsubishi Yuka Co., Ltd.). The following was defined to be the requirement for evaluation.

A: less than $10^2$ Ω·cm

B: $10^2$ Ω·cm or more

2. Molding property

Conditions when molding a flanges and flanges after being processed were visually observed. They were evaluated generally, and evaluated under the following requirements.

A: No problem

B: There was at least one problem in either issues.

3. Image quality

Initial image quality was evaluated in terms of fogging of an actual copied image, maximum density and image uneven step.

Durability was evaluated in terms of that to what extent the above-mentioned characteristics can be maintained, and evaluated under the following requirements.

A: Image quality was favorable up to 300,000 copies

A': Defective image occurred before 100,000 copies

B: Defective image occurred before 20,000 copies

4. Fire-retardant

In accordance with standard UL94, the following evaluation was conducted:

A: The flange reaches grade VO.

B: The flange does not reach grade VO.

5. Abnormal noise

A: No abnormal noise occurred up to 300,000 copies.

B: Abnormal noise occurred before 300,000 copies has been finished.

TABLE 1

| Photo-receptor drum | Resin | C.B. | Elas-tomer | Penta-antimony oxide | Bromine-containing fire-resistant | Specific volume re-sistance | Molding property | Image quality (Ini-tially) | Image quality (Dura-bility) | Fire-retar-dant property | Abnormal noise |
|---|---|---|---|---|---|---|---|---|---|---|---|
| 1 | 70 | 4 | 8 | 15 | 3 | A | A | A | A | A | A |
| 2 | 67 | 8 | 5 | 7 | 13 | A | A | A | A | A | A |
| 3 | 64 | 18 | 2 | 7 | 10 | A | A | A | A | A | A |
| 4 | 62 | 4 | 6 | 10 | 18 | A | A | A | A | A | A |
| 5 | 66 | 8 | 4 | 15 | 5 | A | A | A | A | A | A |
| 6 | 59 | 18 | 8 | 6 | 9 | A | A | A | A | A | A |
| 7 | 47 | 25 | 0 | 15 | 13 | A | A | A | A' | A | A |
| 8 | 73 | 2 | 5 | 7 | 0 | A | A | A | A | B | A |
| Compara-tive 1 | 84 | 15 | 1 | 0 | 3 | A | A | A | B | B | B |

Resin: Polybutylene terephthalate

Elastomer: For photoreceptor drums 1 through 3, 7 and 8 of the Example and for photoreceptor drums 1 of the Comparative example, a polyester polyether type was employed. For photoreceptor drums 4 through 6, a polyester polyester type was employed.

Bromine-containing fire-retardant: tetrabromocyclododecane

As apparent from the results of Table 1, though samples 1 to 6 have no problems in all properties, comparative samples 1 have some properties in some properties so that it can be understood that they do not reach the targeted level of the present invention.

As is apparent from the above explanation, according to the photoreceptor drum of the present invention, durability in which sure slide-contacting property and grounding property (grounding) can be assured even after using for a long period can be provided.

Owing to the present invention, grounding of the photoreceptor drum can sufficiently be conducted, and a photoreceptor drum excellent in mechanical strength in which abrasion with a rotation shaft and damage do not occurred an improved flange having no occurrence of noise during operation time and defective image are integral can be provided.

We claim:

1. A photoreceptor drum in which flanges are provided at ends of a cylindrical electric conductive substrate having a photoconductive layer, wherein the flange contains a heat-resistant thermo-plastic resin and a metal compound comprising a metal selected from the group consisting of Sb, Sn, Pb, Ge, Ga and Zn and a carbon filler having 10 $m^2/g$ or more in terms of BET specific surface area.

2. The photoreceptor drum of claim 1 wherein the flange contains a polyester elastomer.

3. The photoreceptor drum of claim 2 wherein the polyester elastomer comprises

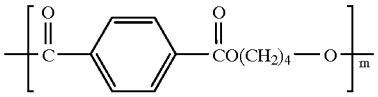

wherein m is 5 to 25.

4. The photoreceptor drum of claim 1 wherein the metal of the compound is Sb.

5. The photoreceptor drum of claim 4 wherein the compound contains an oxide of antimony.

6. The photoreceptor drum of claim 5 wherein the compound is antimony pentaoxide.

7. The photoreceptor drum of claim 1 wherein said heat resistant thermo-plastic resin is a polycarbonate, a polyethylene terephthalate, a polybutylene terephthalate, or an ABS.

8. The photoreceptor drum of claim 7 wherein said heat-resistant thermo-plastic resin is a polybutylene terephthalate.

9. The photoreceptor drum of claim 1 wherein the flange contains a fire retardant.

10. The photoreceptor drum of claim 9 wherein the flange contains 55 to 80 parts by weight of said heat-resistant thermo-plastic resin, 2 to 15 parts by weight of said metal compound, 2 to 8 parts by weight of polyester elastomer, 4 to 20 parts by weight of the carbon filler, and 3 to 20 parts by weight of the fire retardant.

11. The photoreceptor drum of claim 9 wherein the fire retardant contains bromine.

12. The photoreceptor drum of claim 11 wherein the fire retardant is selected from the group consisting of a tetrabromocyclododecane, a bistribromophenoxyethane, a tribromophenol, an ethylenebistetrabromophthalimide, a polydibromophenylene oxide, a pentabromobenzylpolyacrylate, and a tetrabromophathalic acid.

13. The photoreceptor drum of claim 1 wherein the flange comprises a flange shaft bearing member adapted to support said photoreceptor drum on a shaft.

14. The photoreceptor drum of claim 13 wherein the flange shaft bearing member contains the thermoplastic resin, the metal compound, and the carbon filler.

15. A photoreceptor drum in which flanges are provided at ends of a cylindrical electric conductive substrate having a photoconductive layer, wherein the flange is comprised of a heat-resistant thermo-plastic resin and which contains a polyester elastomer, carbon black, antimony pentaoxide, and a bromine-containing fire-retardant in the resin.

16. The photoreceptor drum of claim 15 wherein the flange contains 55 to 80 parts by weight of said heat-resistant thermo-plastic resin, 2 to 15 parts by weight of said metal compound, 2 to 8 parts by weight of polyester elastomer, 4 to 20 parts by weight of the carbon filler, and 3 to 20 parts by weight of the fire retardant.

17. The photoreceptor drum of claim 15 wherein the fire retardant is selected from the group consisting of a tetrabromocyclododecane, a bistribromophenoxyethane, a tribromophenol, an ethylenebistetrabromophthalimide, a polydibromophenylene oxide, a pentabromobenzylpolyacrylate, and a tetrabromophathalic acid.

18. A photoreceptor drum in which flanges are provided at ends of a cylindrical electric conductive substrate having a photoconductive layer, wherein the flange contains a heat-resistant thermo-plastic resin and metal compound comprising a metal selected from the group consisting of Sb, Sn, Pb, Ge, Ga and Zn, a carbon filler, and a bromine-containing fire retardant.

* * * * *